United States Patent [19]

Schiron

[11] 4,043,462

[45] Aug. 23, 1977

[54] LOADING PLATE STRUCTURE ADAPTED TO BE STACKED

[75] Inventor: Dieter Schiron, Ahlem, Germany

[73] Assignee: Continental Gummi-Werke Aktiengesellschaft, Hannover, Germany

[21] Appl. No.: 650,074

[22] Filed: Jan. 19, 1976

[30] Foreign Application Priority Data

Jan. 17, 1975 Germany ..... 2501689

[51] Int. Cl.[2] ..... A47F 5/10

[52] U.S. Cl. ..... 214/10.5 R; 105/373; 108/53.3; 108/55.1; 206/304

[58] Field of Search ..... 108/53.3, 55.1; 206/304; 211/173, 19-21; 5/282, 285, 331; 214/10.5 R; 105/366 R, 373

[56] References Cited

U.S. PATENT DOCUMENTS

| | | | |
|---|---|---|---|
| 3,405,412 | 10/1968 | Mixon | 5/331 X |
| 3,513,785 | 5/1970 | Bennett et al. | 108/55.1 |
| 3,850,295 | 11/1974 | Black | 214/10.5 R X |

FOREIGN PATENT DOCUMENTS

| | | | |
|---|---|---|---|
| 873,649 | 7/1961 | United Kingdom | 214/10.5 R |

*Primary Examiner*—Frank E. Werner
*Attorney, Agent, or Firm*—Walter Becker

[57] ABSTRACT

A loading plate structure adapted together with other loading plate structures of the same design to form a stack, which includes a preferably rectangular or square-shaped normally horizontal loading plate which at each of its corner sections has connected thereto a supporting post of square, rectangular or any other polygonal cross section. Each post has preferably detachably connected to its top and bottom section the free ends of the two arms of a U-shaped yoke. Each yoke projects from the post to which it is connected in the direction to the adjacent yoke, and the transverse section of each U-shaped yoke which interconnects the pertaining two arms is spaced from the pertaining post by a distance that is less than half the distance between the two adjacent posts between which the respective U-shaped yokes project.

7 Claims, 3 Drawing Figures

LOADING PLATE STRUCTURE ADAPTED TO BE STACKED

Figure 1:
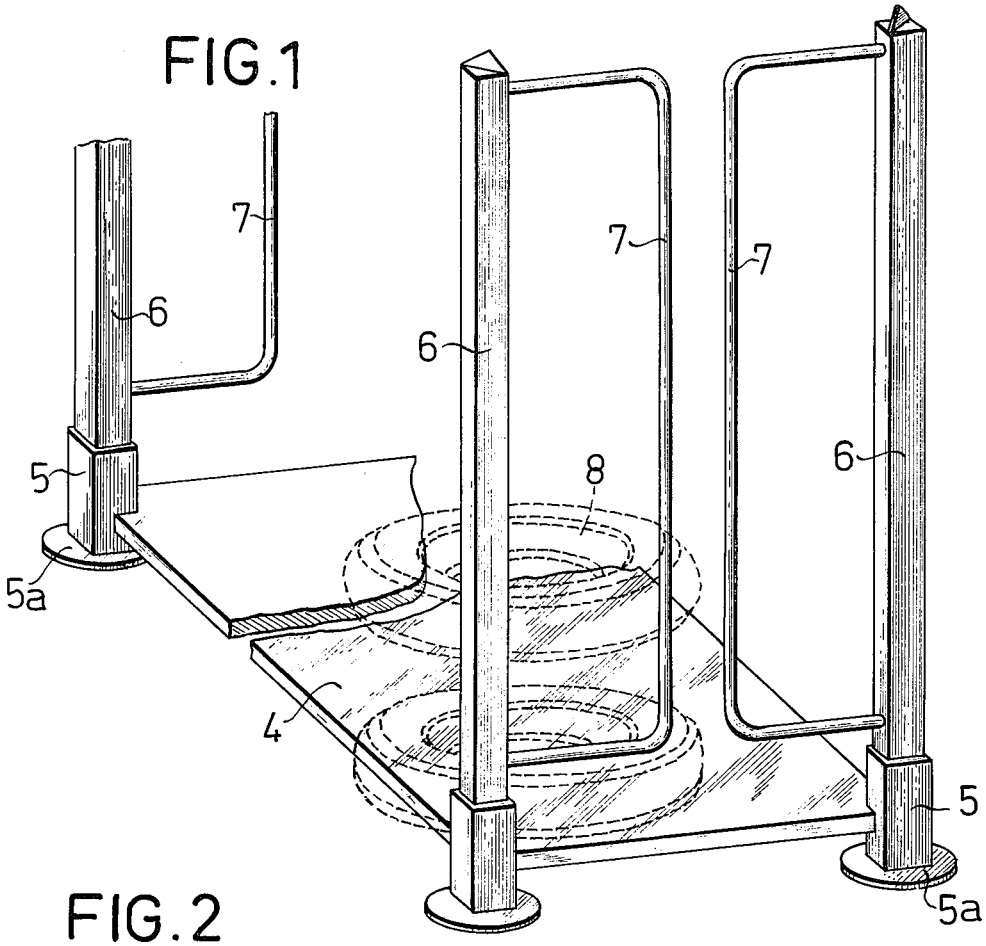

The present invention relates to loading plates adapted to be stacked which are provided with preferably removable tubular supports for receiving a further mounted loading plate and holding elements inserted between adjacent supports and supporting the material to be loaded.

The customary loading plates for transporting and/or for storing articles of various types are, if having a square or rectangular base shape, in most instances at their corner points equipped with supports which are fixedly or detachably arranged in order to be able to stack the same one upon the other in the form of a plurality of units. These supports simultaneously define also the available loading space and form rigid abutments for the materials to be loaded. Since said supports in linear extension are limited to a few points of the circumference of the loading plate, these supports by themselves are not sufficient effectively to hold together the material to be loaded, and in such instances it is necessary to bridge the space between the respective adjacent supports by wall elements. The construction and quality of such wall elements depend on the type of the load of the material to be loaded and transported and may take on various forms of simple struts and also of full walls.

Considering the fact that the loading plates utilized for instance in industrial plants, storage places, in the transport of freight, and also for the transloading and the storing of fuels and articles are always used in greater numbers, the structural design is of great importance. It will be appreciated that already slight increases in costs in the manufacture or maintenance of loading plates would add up to an amount that would affect the economy of the respective transport and storing costs. In addition to the effective support of the material to be loaded, also the desire to assure a possibly unimpeded access to the loading surface of the plates is important while, for reason of economy, also a high capacity of the loading units is desired. In this respect, the handling for instance of pneumatic vehicle tires and similar articles represents a particular problem due to the torus shape of such tires and due to their elastic deformability and the inherent sensitivy against mechanical damage. By placing the tires in layers and in an inclined arrangement one upon the other in the manner of overlapping fish scales or roof tiles, the receiving capacity of the customary loading plates can be increased. However, an additional support of the rows of stacks on the loading plates was unavoidable at their end faces.

It is an object of the present invention for the design of this additional support to be effected between adjacent supporting members to provide an optimum with regard to the manufacturing costs as well as to their handling and technical effect.

These and other objects and advantages of the invention will appear more clearly from the following specification, in connection with the accompanying drawings, in which:

FIG. 1 is an isometric view of a loading plate according to the invention in partially loaded condition.

Figure 2:
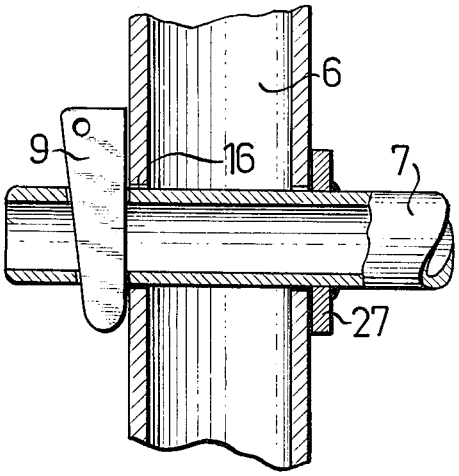
Figure 3:
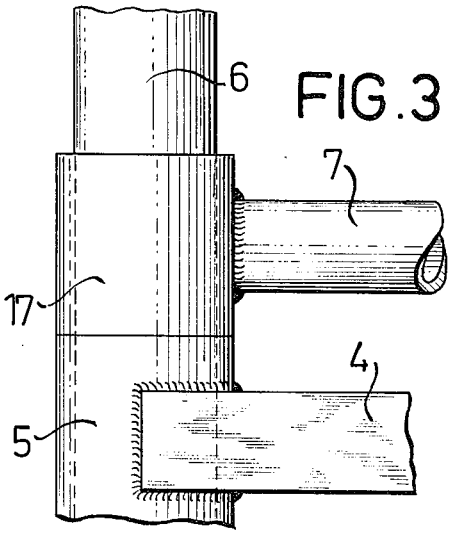

FIGS. 2 and 3 respectively illustrate different connections of the yokes with the supporting members, partially in section and on a larger scale than that of FIG. 1.

The loading plates according to the present invention are characterized primarily in that the holding elements for the additional support are designed as yokes arranged in the foot and top region of each supporting member while the yokes have a width which is less than half the distance between adjacent supporting members. According to an important feature of the invention, the yokes are in a non-rotatable connection detachably arranged on the supporting members. To this end, the yokes have for instance their free legs inserted into continuous bores in the supporting elements or instead thereof they may be provided at their free ends with sleeves which are adapted to be placed upon the supporting members and may be arrestable against relative rotations. A particularly simple construction is obtained when employing supporting members with a cross section different from a circular cross section, for instance supporting members produced from tubular material with a square or rectangular cross section, because in such an instance the free ends of said yokes can be provided with sleeves extending around the supporting members.

Referring now to the drawings in detail, the loading plate illustrated in FIG. 1 consists primarily of a bottom plate 4 of a rectangular shape which is provided with four receiving sleeves 5 formed from pipe sections and welded to the four corner regions. The receiving sleeves 5 are provided with foot discs 5*a*. The receiving sleeves 5 serve for placing the loading plate on the floor of a hall in a distance which is sufficient to permit grasping the bottom plate 4 from below the lifting forces of lifting trucks or the like, and furthermore serve at the same time for loosely inserting the supporting members 6. In the illustrated embodiment, the supporting members 6, similar to the receiving sleeves 5, are produced to commercially available square or rectangular rolled pipes.

Mounted on the supporting members 6 nearly over the entire length thereof are yokes 7 which are so arranged that they project toward each other at the narrow sides of the rectangular loading plate up to about one third of the distance between the supporting members 6. The yokes 7 are made of round tubular pipe having outer dimensions which are considerably less than those of the supporting members 6. These yokes are bent to the form of a rectangle but with three sides of the rectangle formed by tubular pipe while the fourth side of the rectangle is formed by one of the supporting members 6.

In this form, the yokes form a reliable hold to the vehicle tires 8 which are stacked one upon the other as loading material while the stack of the tires is so-to-speak positively supported at its ends.

FIG. 2 illustrates a stack connection which is not limited to square or rectangular profiles and which is provided between the yoke and the supporting member as possible modification of the invention. More specifically, with this design, the free leg ends of the yoke 7 are inserted into a bore 16 of the pertaining supporting members 6 and are secured in position by a wedge or key 9. For limiting the insertion and as an abutment there may be provided a disc 27 which is connected to the legs of the yoke 7, e.g. by welding.

According to the arrangement shown in FIG. 3, the bent-off free legs of the yoke 7 are provided with sleeves 17 which have a square or rectangular shaped configuration in conformity with the configuration of the supporting members 6. These sleeves 17 may be placed upon the supporting members with loose fit. In condition of use, the yokes 7 have their lower sleeve 17 resting on the upper edge of the receiving sleeve 5 and do not require any additional connecting means, whereas on the other hand due to the square or rectangular cross section the desired non-rotatable connection is assured.

As will be evident from the above, the present invention leads to an additional support for the material to be loaded, which additional support is surprisingly simple over heretofore known holding means and can be produced at a low cost with a minimum of elements. This design in addition to the economical advantages inherent thereto also assures a maximum of functional efficiency. The manufacture of the yoke-shaped elements, expediently of pipe of a considerably smaller cross section than that of the supporting elements 6, offers no difficulties whatsoever and, aside from the preparation of the free yoke ends, is possible without welding and other time-consuming operations. Practically, only pipes cut to length are to be bent to the respective yoke form. The connection of the finished yokes with respectively one supporting member 6 only avoids the necessity to maintain precise spacings and fittings and in addition thereto facilitates the withdrawal of the supporting elements for transporting the loading plates in empty condition. The limit of the width of the yoke to a measurement of clearly less than half the distance between the adjacent supporting elements 6 will in an installed condition of the yokes assure the mutual distance which for the support especially of stacked pneumatic tires acts advantageously upon the loading plate. Since normally only articles of the same or similar type and size are loaded on a loading plate, the yokes according to a preferred embodiment of the invention may have the contour of open rectangles due to the respective supporting element 6 forming a longitudinal side of the respective rectangle.

It is, of course, to be understood that the present invention is, by no means, limited to the specific showing in the drawings but also comprises any modifications within the scope of the appended claims. Thus, while the supports or posts 6 of FIG. 1 are shown as having a square cross section, they may instead have any other polygonal cross section.

What I claim is:

1. A loading plate structure adapted with other loading plate structures of the same design to form a stack of pneumatic tires with the least possible work and complexity upon a prescribed loading surface, which includes in combination: a loading plate having at least two pairs of oppositely located sides, two pairs of corner posts, each of said pairs of posts having one post connected to each end of one pair of oppositely located sides, and two pairs of U-shaped yokes, each yoke having two arms joined together by connecting means at one end of each arm, the two arms of each yoke at their free ends being connected to one post but each yoke being connected to a different post, the arms of the yokes of each pair of posts extending in a direction toward each other with the connecting means being spaced from each other, each of said posts having a bottom and a top section, the arms of each yoke being respectively connected to the bottom and top sections of the pertaining posts, the yokes being respectively slidably detachably connected to the pertaining posts and non-rotatably secured thereto.

2. A loading plate structure according to claim 1, in which said posts at their top and bottom sections are provided with bores extending through said posts for receiving the respective free end portions of the arms of the pertaining yoke.

3. A loading plate structure according to claim 2, in which the free end portions of said arms are provided with a longitudinal slot, and in which said arms respectively extend through said bores to such an extent as to expose said slot therein for receiving a wedge to fixedly secure the respective arm to the pertaining posts, said arms also being provided with abutment means spaced from said slot in the axial direction of the respective arm to limit the extent to which the respective arm can be passed through the respective bore.

4. A loading plate structure in combination according to claim 1, in which the free ends of the arms of said yokes are respectively provided with sleeves each having bores of a cross section conforming to the outer cross sectional contour of said post and being in non-rotatable slidable engagement with said posts.

5. A loading plate structure in combination according to claim 1, in which said posts have a non-round outer cross sectional contour and in which the two arms of each yoke have their free ends provided with sleeve means positively surrounding the respective pertaining post.

6. A loading plate structure in combination according to claim 1, in which each yoke together with the respective post engaged thereby defines a rectangle.

7. A loading plate structure according to claim 1, in which said yokes are made of pipe having a considerably shorter diameter than that of said posts.

* * * * *